US008348057B1

(12) United States Patent
Lee

(10) Patent No.: US 8,348,057 B1
(45) Date of Patent: Jan. 8, 2013

(54) ANTI-THEFT TOOLBOX

(76) Inventor: Hong-Jen Lee, Taichung (TW)

( * ) Notice: Subject to any disclaimer, the term of this patent is extended or adjusted under 35 U.S.C. 154(b) by 0 days.

(21) Appl. No.: 13/603,454

(22) Filed: Sep. 5, 2012

(51) Int. Cl.
*B65D 45/18* (2006.01)

(52) U.S. Cl. ..... 206/378; 206/1.5; 220/324

(58) Field of Classification Search ..... 206/372, 206/373, 376, 378, 1.5; 220/324
See application file for complete search history.

(56) References Cited

U.S. PATENT DOCUMENTS 6,789,670 B2 * 9/2004 Cooper et al. ..... 206/349
7,401,698 B2 * 7/2008 Dost et al. ..... 206/349
7,931,143 B1 * 4/2011 Lin ..... 206/373
2006/0091032 A1 * 5/2006 Tsai ..... 206/373
2008/0067095 A1 * 3/2008 Mueller ..... 206/373
2008/0264946 A1 * 10/2008 Moschella et al. ..... 220/326

* cited by examiner

*Primary Examiner* — Jacob K Ackun

(57) ABSTRACT

The present invention relates to an anti-theft toolbox comprising a lower frame, an upper frame and a locking element. The lower frame and the upper frame latch together by locking portions. The locking portions have notches. The locking element has two tighten masses with a groove spanned across them. The inner wall of the groove has opposite flanges. The flanges are anchored into the corresponding notches. The two tighten masses are bound by a plurality of binding portions which has a hollow in-between every two adjacent binding portions.

10 Claims, 11 Drawing Sheets

ANTI-THEFT TOOLBOX

FIELD OF THE INVENTION

The present invention relates to a toolbox, particularly to a toolbox for placing hand tools with anti-theft function.

BACKGROUND OF THE INVENTION

A prior art toolbox shown as FIG. 18, the toolbox 50 comprises a lower frame 51 and an upper frame 52. The lower frame 51 has a first locking portion on its rear side and a first locking hole 511 on its front side. The first locking hole 511 is distanced from the first locking portion. The upper frame 52 has a second locking portion on its rear side to latch with the corresponding first locking portion for the upper frame 52 and the lower frame 51 to be joined together. The upper frame 52 also has a second locking hole 521 which is exactly corresponding to the first locking hole 511. The first locking hole 511 and the second locking hole 521 can be buckled by a lock for the lower frame 51 and the upper frame 52 to be tightly locked. Therefore, the toolbox 50 is equipped with anti-theft function. When the lock is removed from the first locking hole 511 and the second locking hole 521, the upper frame 52 is able to be opened against the lower frame 51 for the hand tools to be acquired from the toolbox 50.

However, the anti-theft mechanism of the toolbox 50 still has certain disadvantages. First, the lower frame 51 and the upper frame 52 have the first locking hole 511 and the second locking hole 521 dented on their front sides. the indentations from the first locking hole 511 and the second locking hole 521 make the appearance of the toolbox 50 unsatisfactory, especially facing toward potential buyers while displayed for sale. Second, the indentations the toolbox 50 from the first locking hole 511 and the second locking hole 521 also take up some inner space of the lower frame 51 and the upper frame 52, and therefore the capacity of the toolbox is reduced.

SUMMARY OF THE INVENTION

The object of the present invention is to provide an anti-theft toolbox with a satisfactory appearance and capacity. In order to achieve the foregoing object, the present invention is designed to comprise a lower frame, an upper frame and a locking element. A first locking portion and a second locking portion latched together are defined on the lower frame and the upper frame respectively. A first notch and a second notch are defined on the first locking portion and the second locking portion respectively. The locking element has a first tighten mass and a second tighten mass with a groove spanned across them. The inner wall of the groove has a first flange and a second flange corresponding to each other. The first flange and the second flange are anchored into the first notch and the second notch respectively. The first tighten mass and the second tighten mass are bound by a plurality of binding portions which has a hollow in-between every two adjacent binding portions.

DETAILED DESCRIPTION OF THE PREFERRED EMBODIMENT

Figure 2:
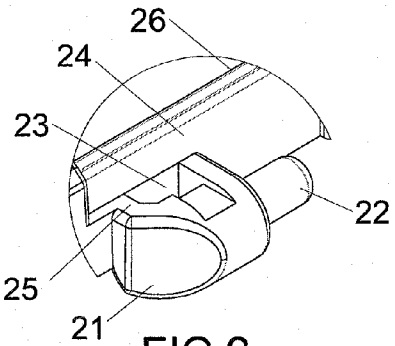
FIG. 2 is an enlarged view of circle A in FIG. 1.
Figure 3:
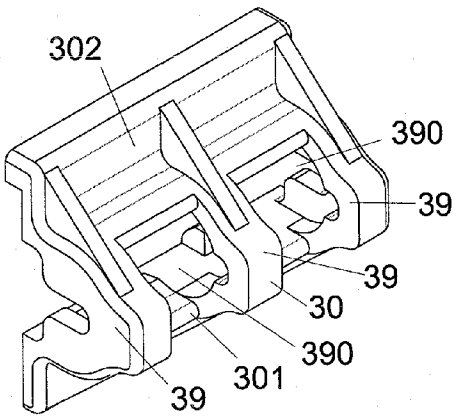
FIG. 3 is a perspective view of the locking element in accordance with the present invention.
Figure 1:
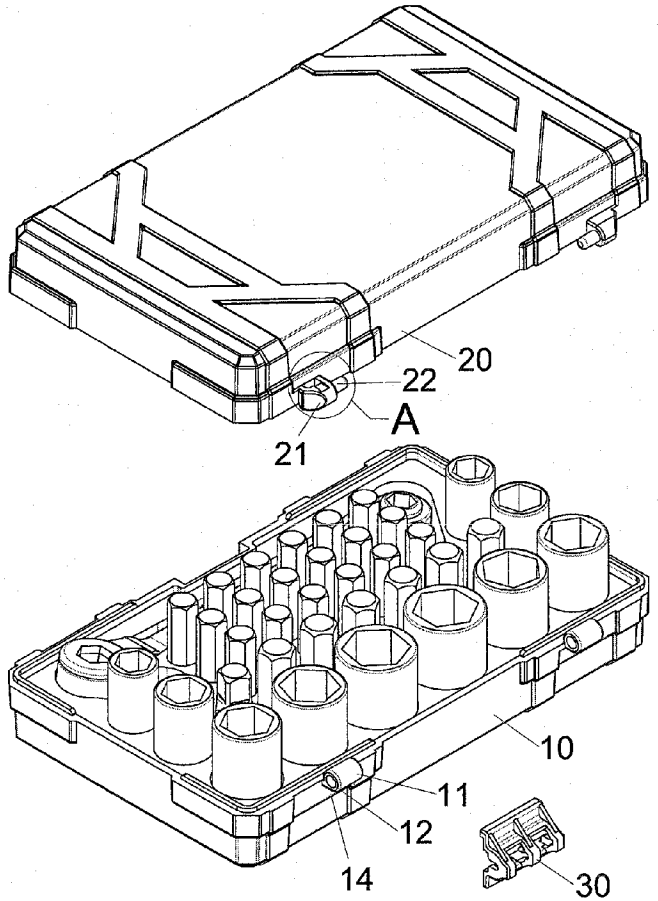
FIG. 1 is an exploded drawing of the toolbox in accordance with the present invention.
Figure 5:
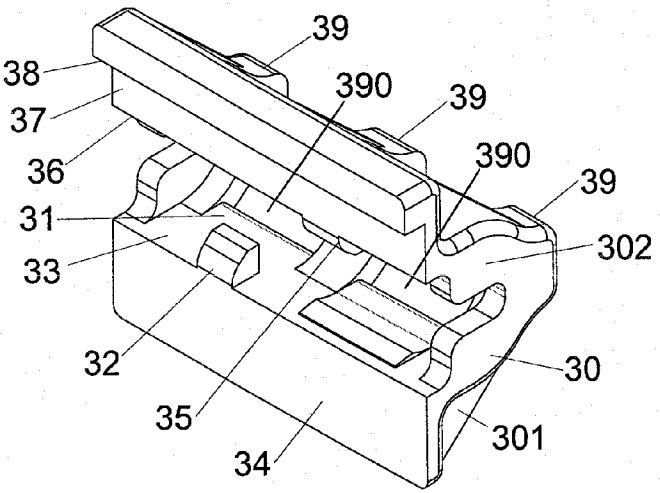
FIG. 5 is a perspective view of the locking element from another angle in accordance with the present invention.
Figure 4:
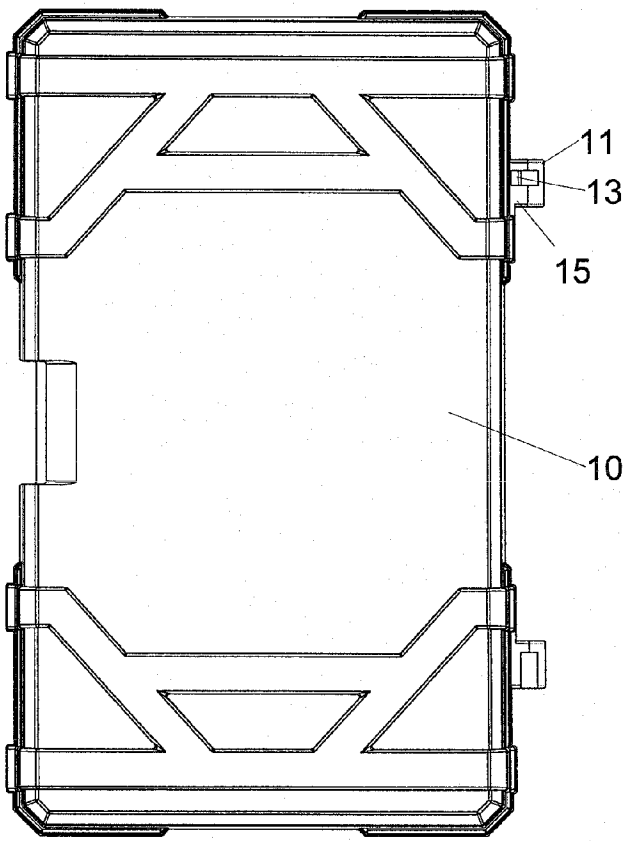
FIG. 4 is a bottom view of the toolbox in accordance with the present invention.
Figure 6:
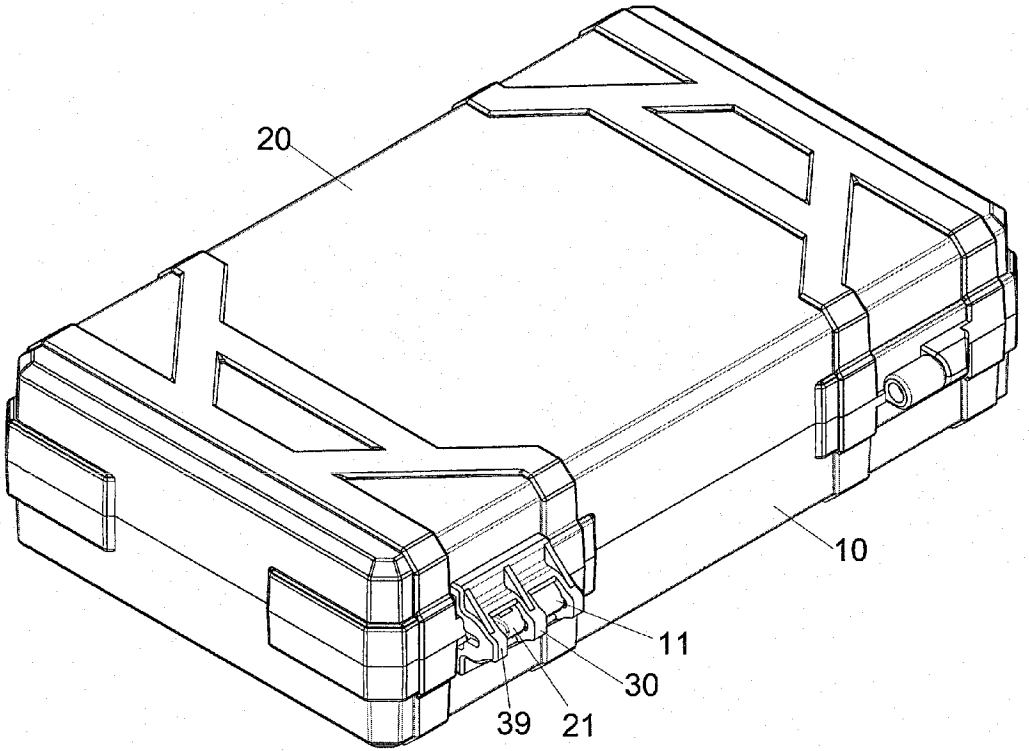
FIG. 6 is an assembled perspective view of the toolbox in accordance with the present invention.
Figure 8:
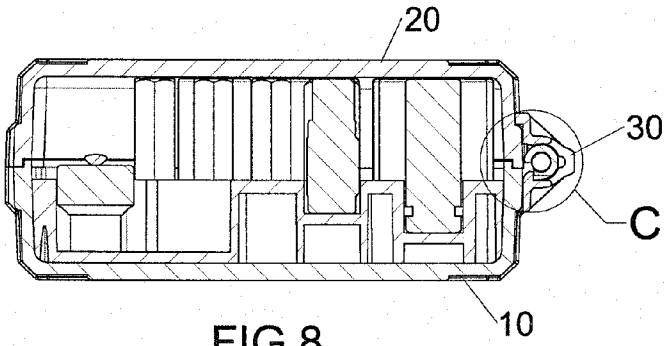
FIG. 8 is a cross sectional view taken along plane B-B in FIG. 6.
Figure 9:
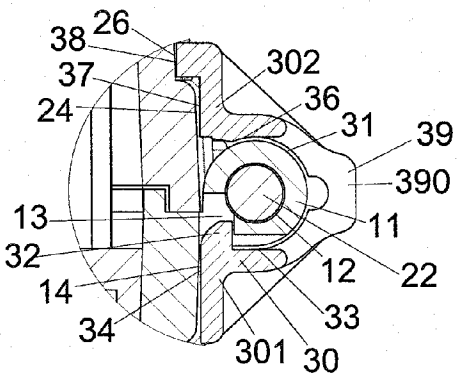
FIG. 9 is an enlarged view of circle C in FIG. 7.
Figure 7:
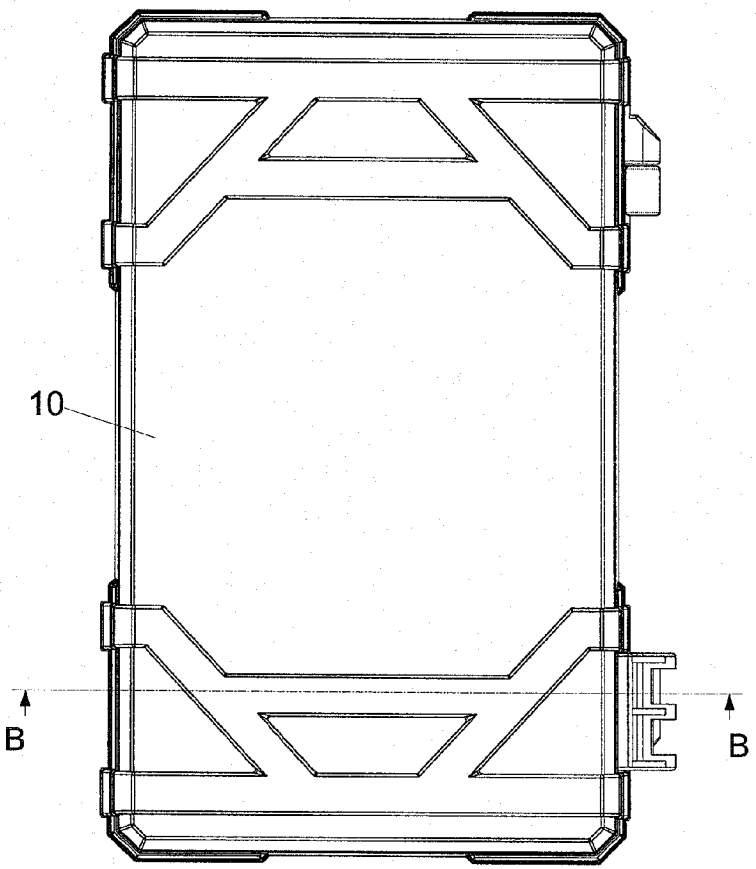
FIG. 7 is a top view of the toolbox in accordance with the present invention.

Referring to FIGS. 1 to 6, the toolbox of the present invention comprises a lower frame 10, an upper frame 20 and a locking element 30.

The lower frame 10 has a first tighten surface 14 and a protruded first locking portion 11 defined on its rear side. The first locking portion 11 has a horizontally penetrated locking duct 12. On the first locking portion 11, near the junction of the lower frame 10, is a vertically penetrated first notch 13 in rectangular slot shape. The first locking portion 11 also has a second tighten surface 15, facing toward the bottom portion of the lower frame 10, and the second tighten surface 15 is turn direction with respect to the first tighten surface 14 (shown in the figures, second tighten surface 15 is perpendicular to first tighten surface 14).

The upper frame 20 has a second locking portion 21 with a horizontally protruded latch 22 on its rear side. The latch 22 is inserted into the locking duct 12 for the second locking portion 21 and the first locking portion 11 to be latched together. In the mean time, the lower frame 10 and the upper frame 20 are latched as well. On the second locking portion 21, near the junction of the upper frame 20, is a vertically penetrated second notch 23 in rectangular slot shape. The openings of the first notch 13 and the second notch 23 direct toward the vertical axis of the latch 22. The second locking portion 21 also has a fourth tighten surface 25 facing toward the top portion of the upper frame 20. The fourth tighten surface 25 and the second tighten surface 15 are respectively facing in opposite directions. On the rear side of the upper frame 20 are a third tighten surface 24 and a concave edge 26. The fourth tighten surface 25 is turn direction with respect to the third tighten surface 24 (shown in figures, fourth tighten surface 25 and third tighten surface 24 are perpendicular to each other).

The locking element 30 is one-piece molded by plastic injection comprising a first tighten mass 301, a second tighten mass 302, a groove 31 and a plurality of binding portions 39

(there are three binding portions 39 shown in the figures). The groove 31 is transversely formed across the first tighten mass 301 and the second tighten mass 302, i.e. the groove 31 transversely lies on the first tighten mass 301 and the second tighten mass 302. The first tighten mass 301 and the second tighten mass 302 are laterally arranged with certain space corresponding to the axis of the latch 22 for the groove 31 to be longitudinally formed along the axis of the latch 22. Therefore, two lateral sides of the groove 31 locates on the first tighten mass 301 and the second tighten mass 302 respectively. On the bottom of the groove 31, a plurality of binding portions 39 is employed to joint the first tighten mass 301 and the second tighten mass 302 side by side. There is a hollow 390 in-between every two adjacent binding portions 39. The first locking portion 11 and the second locking portion 21 are located in the groove 31 whose inner wall has a first flange 32 and a second flange 35 with their tips pointing to opposite directions. The first flange 32 and the second flange 35 are respectively located on two opposite lateral walls of the groove 31, and are employed to be anchored in the first notch 13 and the second notch 23 respectively. The inner wall of the groove 31 has a first anchor surface 33 and a third anchor surface 36 defined corresponding to each other. On the locking element 30, there are a second anchor surface 34 and a fourth anchor surface 37 respectively defined beside two sides of the opening 310 of the groove 31. The fourth anchor surface 37 has a protruded edge 38 extended at its end portion. The first anchor surface 33, the third anchor surface 36, the second anchor surface 34 and the fourth anchor surface 37 are anchored against the second tighten surface 15, the fourth tighten surface 25, the first tighten surface 14 and the third tighten surface 24 respectively. The protruded edge 38 is anchored in the concave edge 26 as well. Furthermore, at one side edge of their end portions, both the first flange 32 and the second flange 35 have a guiding angle defined for them to smoothly slide over the first locking portion 21 and the second locking portion 22 and to be anchored into the first notch 13 and the second notch 23 when the locking element 30 is mounted on the first locking portion 21 and the second locking portion 22.

Referring to FIGS. 6 to 9, after the first locking portion 11 of the lower frame 10 and the second locking portion 21 of the upper frame 20 are latched, the locking element 30 is able to mount over the first locking portion 11 and the second locking portion 21. The first flange 32 is able to be anchored into the first notch 13, and second flange 35 is able to be anchored into the second notch 23. The joint portions of the lower frame 10 and the upper frame 20 are tightened by the first tighten mass 301 and the second tighten mass 302 of the locking element 30 respectively, so that the upper frame 20 is unable to be turned and opened against the lower frame 10. Therefore, the anti-theft function of the toolbox can be activated to prevent hand tools in the toolbox from stealing.

Figure 10:
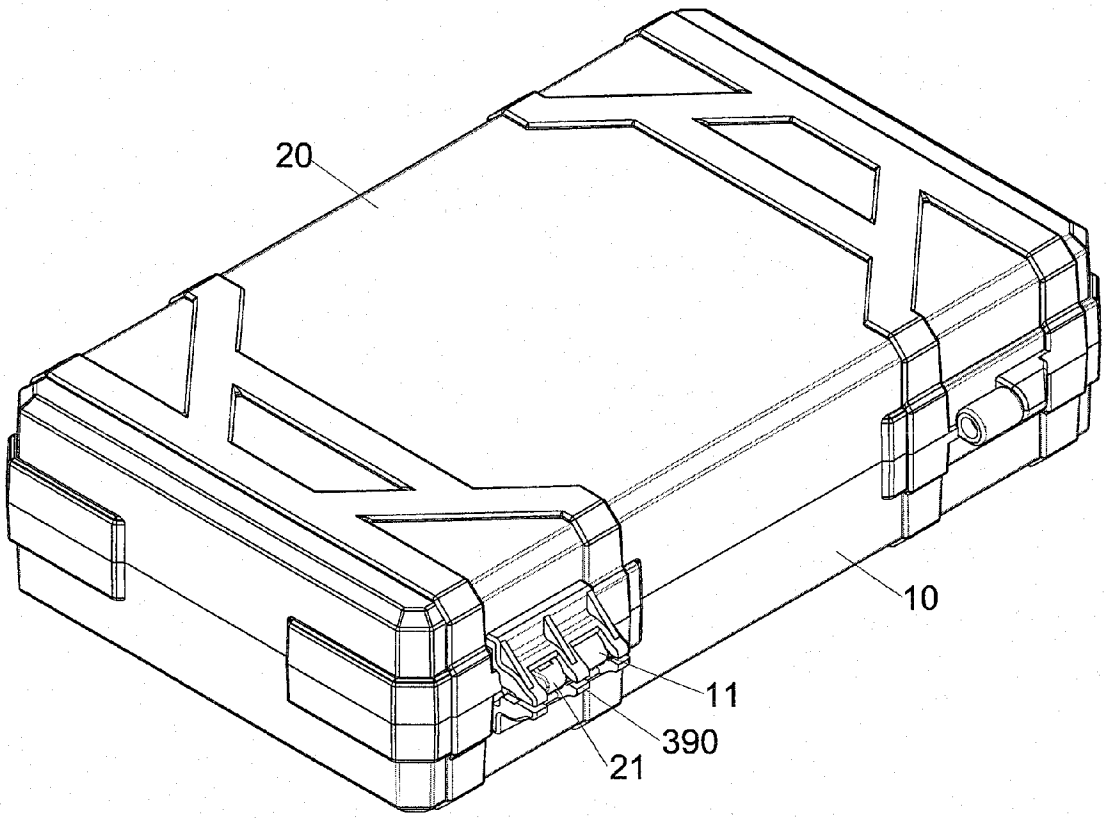
FIG. 10 is a perspective view of the toolbox with the locking element removed in accordance with the present invention.
Figure 12:
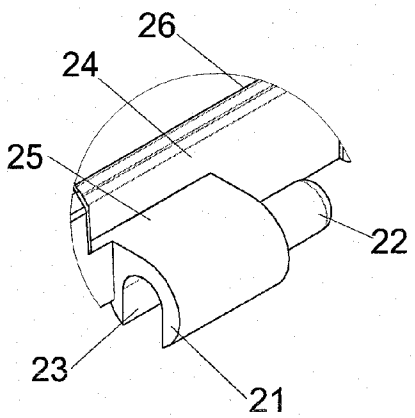
FIG. 12 is an enlarged view of circle A in FIG. 10.
Figure 11:
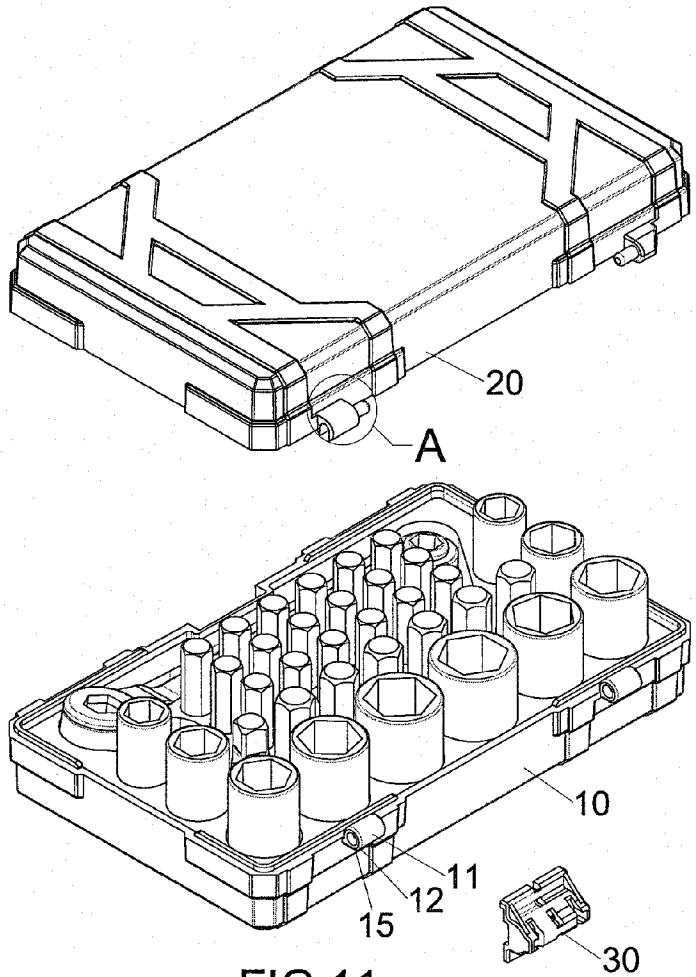
FIG. 11 is an exploded perspective view of the second embodiment in accordance with the present invention.
Figure 13:
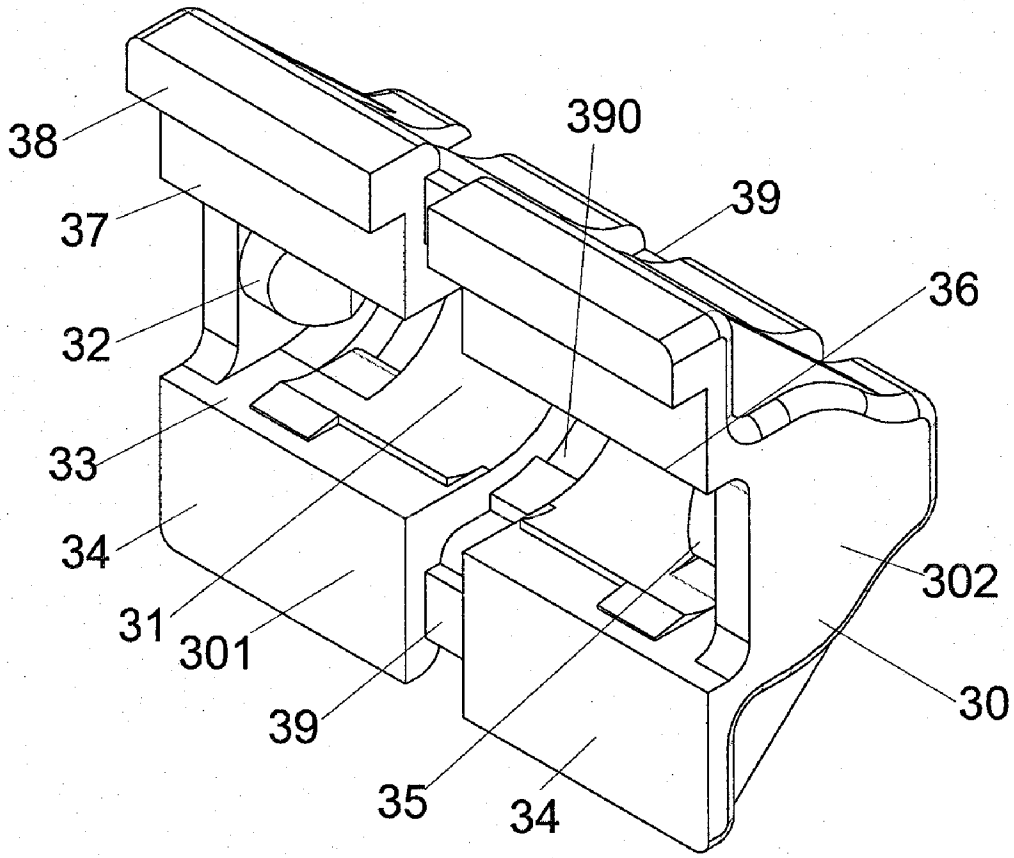
FIG. 13 is a perspective view of the locking element in the second embodiment in accordance with the present invention.

Referring to FIG. 10, the first tighten mass 301 and the second tighten mass 302 are separated and are able to be removed from the first locking portion 11 and the second locking portion 21 respectively when the binding portions 39 are cut off. Therefore, the upper frame 20 is able to be turned and opened against the lower frame 10 for acquiring hand tools inside the toolbox.

Figure 14:
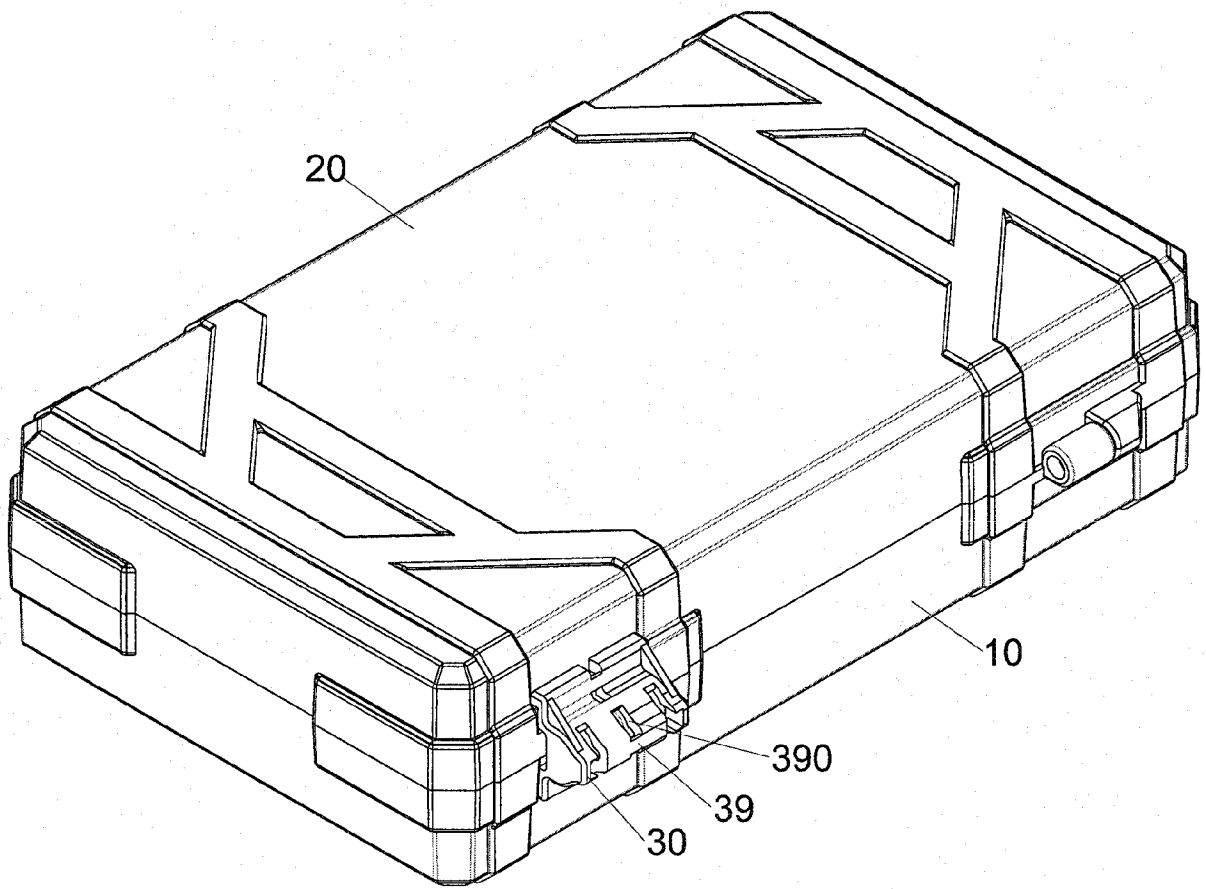
FIG. 14 is a perspective view of the second embodiment in accordance with the present invention.
Figure 16:
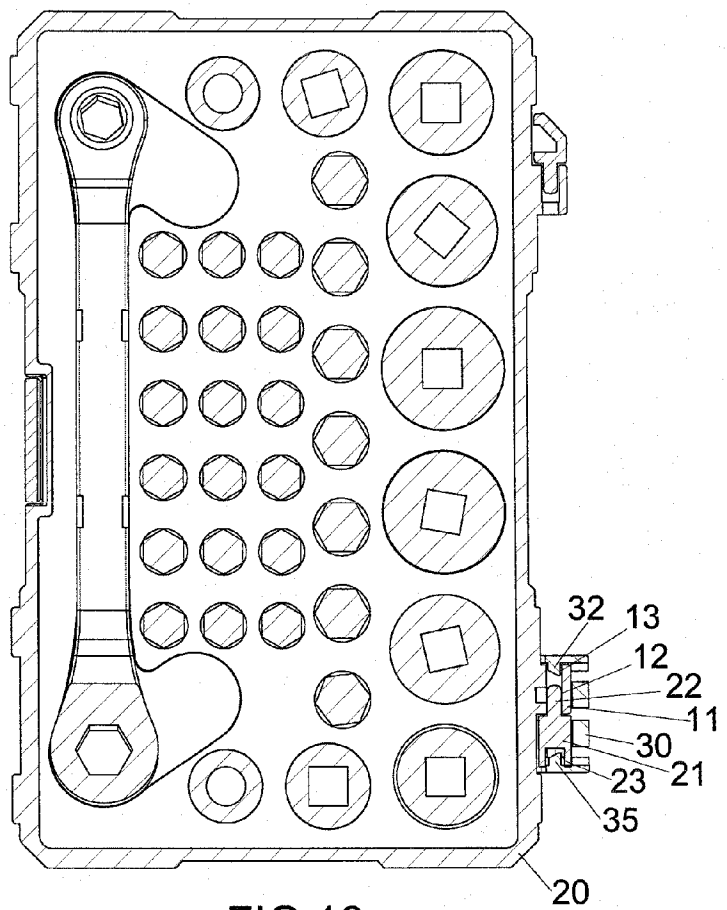
FIG. 16 is a cross sectional view taken along plane D-D in FIG. 14.
Figure 15:
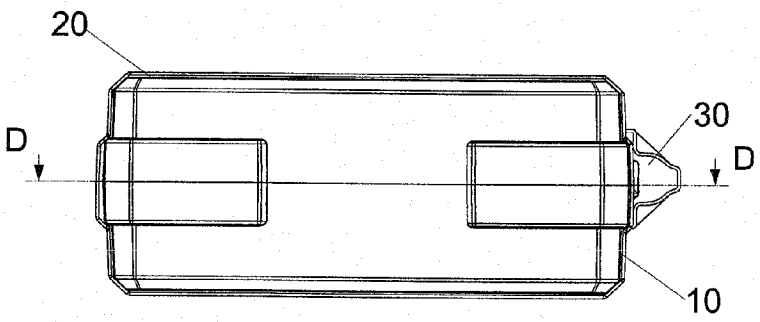
FIG. 15 is a side view of the second embodiment in accordance with the present invention.
Figure 17:
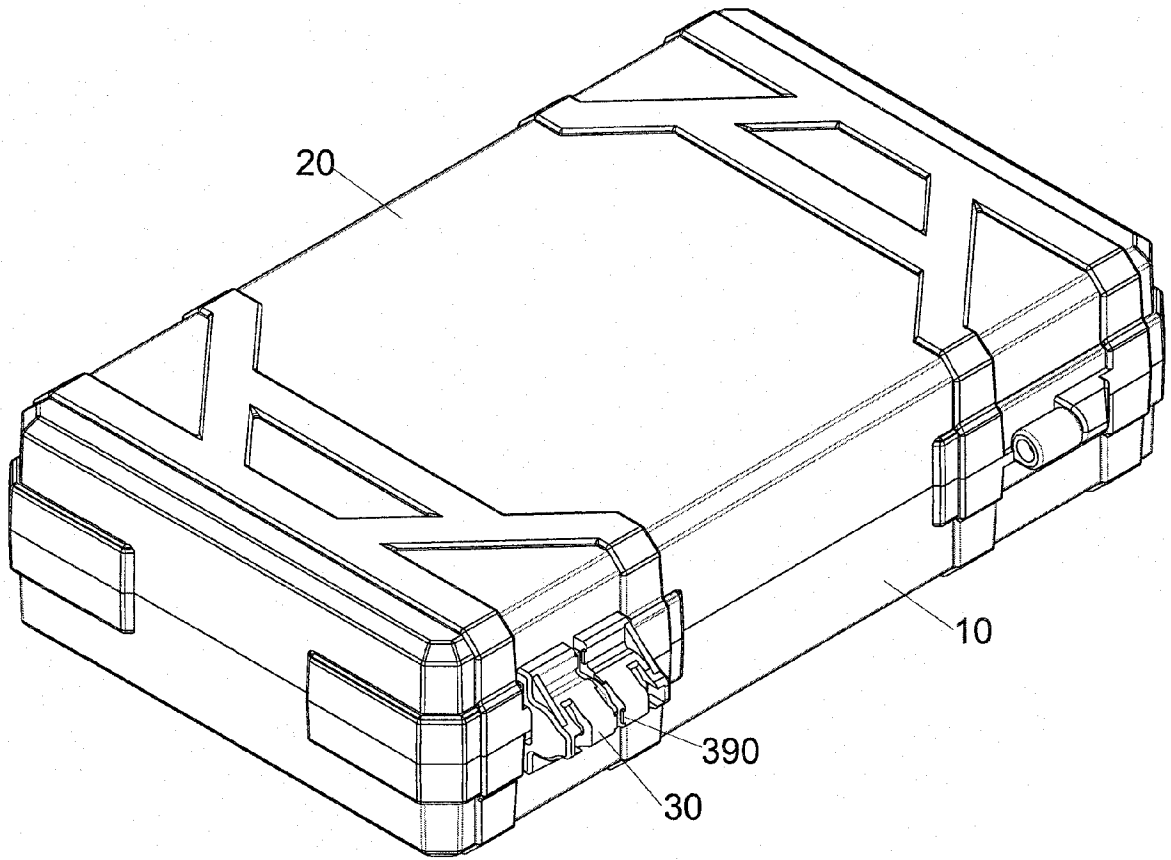
FIG. 17 is a perspective view of the second embodiment with the locking element removed in accordance with the present invention.
Figure 18:
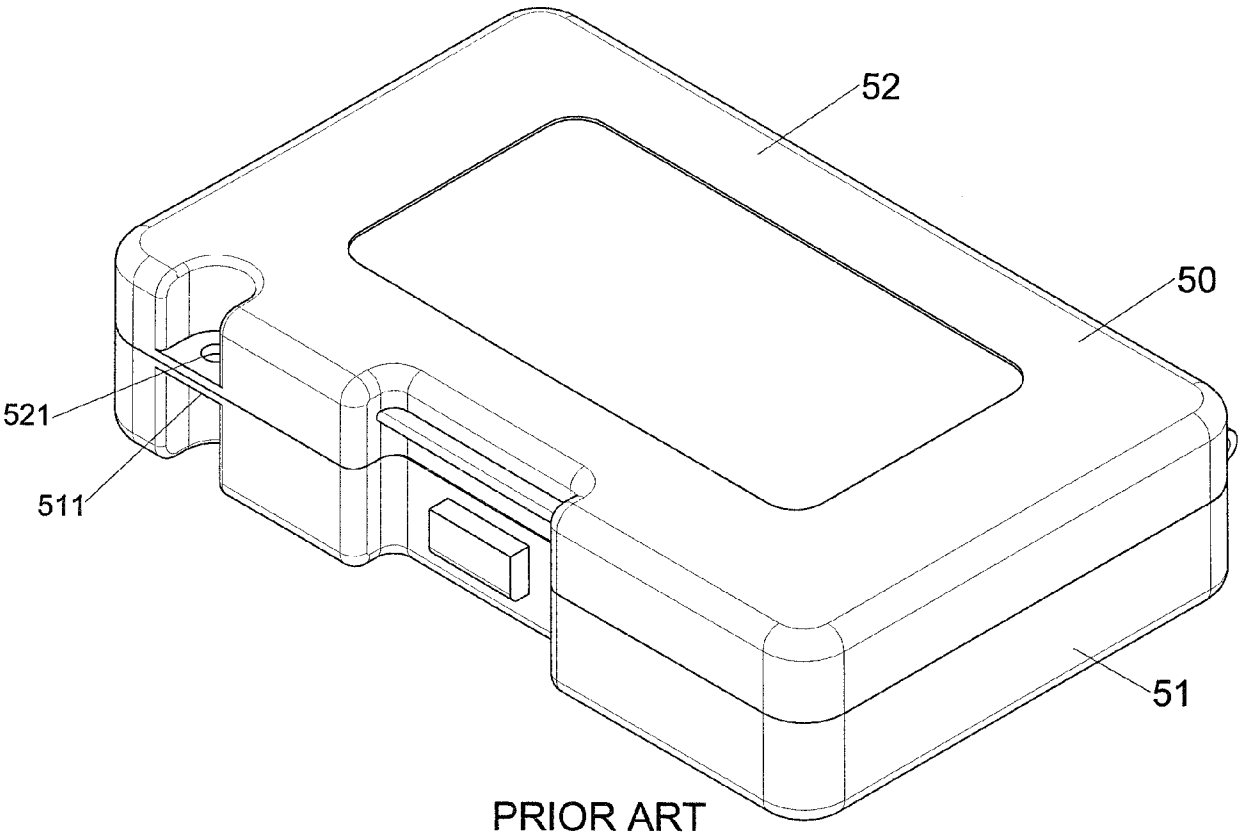
PRIOR ART FIG.18
FIG. 18 is a perspective view of the toolbox in accordance with the prior art.

Referring to FIGS. 11 to 17, there is another locking element 30 embodiment of the present invention. The openings of the first notch 13 and the second notch 23 direct to the axis of the latch 22 in parallel. The first tighten mass 301 and the second tighten mass 302 are distributed along the axis of the latch 22 in parallel. The elongated groove 31 longitudinally lies on the first tighten mass 301 and the second tighten mass 302 in parallel with the axis of the latch 22. The first flange 32 and the second flange 35 are respectively located at two opposite end of the groove 31. Referring to FIGS. 14 and 15, the first locking portion 11 and the second locking portion 21 are latched by the latch 22, and the locking element 30 mounts over the first locking portion 11 and the second locking portion 21. Referring to FIGS. 16 and 17, the first tighten mass 301 and the second tighten mass 302 are separated along the axis of the latch 22 and are able to be removed from the first locking portion 11 and the second locking portion 21 when the binding portions 39 are cut off. Therefore, the upper frame 20 is able to be turned and opened against the lower frame 10.

Advantages of the present invent are detailed as below.

1. The locking element 30 employs the first flange 32 and the second flange 35 to anchor into the first notch 13 and the second notch 23, and it also mounts over the first locking portion 11 and the second locking portion 21 to lock both the lower frame 10 and the upper frame 20. Therefore, the upper frame 20 is unable to be opened against the lower frame 10, so that the anti-theft toolbox can prevent hand tools from stealing before it is sold.

2. Because the locking element 30 mounts over the first locking portion 11 and the second locking portion 21, the toolbox has a more satisfactory appearance when it is displayed for sale.

3. Both the first locking portion 11 and the second locking portion 21 are extended outward, so they would not take up any inner space from the lower frame 10 or the upper frame 20. Therefore, the capacity of the toolbox will be maximized for hand tools.

4. The locking element 30 is detachable. Users can choose to mount or not to mount the locking element 30 on the toolbox for sales display.

While we have shown and described the embodiment in accordance with the present invention, it should be clear to those skilled in the art that further embodiments may be made without departing from the scope of the present invention.

What is claimed is:

1. An anti-theft toolbox comprising:

a lower frame having a first tighten surface and a first locking portion defined on a rear side of the lower frame, and the first locking portion having a first notch and a second tighten surface facing toward a bottom portion of the lower frame;

an upper frame having a second locking portion and a third tighten surface defined on a rear side of the upper frame, the second locking portion and the first locking portion being latched together by a latch, the second locking portion having a second notch and a fourth tighten surface facing toward a top portion of the upper frame, and the second tighten surface and the fourth tighten surface facing opposite directions; and a locking element being one-piece molded by plastic injection comprising a first tighten mass, a second tighten mass, a groove and a plurality of binding portions, the groove formed across the first tighten mass and the second tighten mass, the binding portions employed to joint the first tighten mass and the second tighten mass on the bottom of the groove and having a hollow in-between every two adjacent binding portions, the first locking portion and the second locking portion located in the groove whose inner wall has a first flange and a second flange with their tips pointing to opposite directions, the first flange and the second flange being anchored in the first notch and the second notch respectively, the inner wall of the groove having a first anchor surface and a third anchor surface defined corresponding to each other, a second anchor surface and a fourth anchor surface respectively defined on the locking element beside two sides of the opening of the groove, the second anchor surface and the fourth anchor surface being turn direction with respect to the first anchor surface and the third anchor surface respectively, and the first anchor surface, the second anchor surface, the third anchor surface and the fourth anchor surface anchored against the second tighten surface, the first tighten surface, the fourth tighten surface and the third tighten surface respectively.

2. The anti-theft toolbox as claimed in claim 1, wherein the second tighten surface is vertically next to the first tighten surface.

3. The anti-theft toolbox as claimed in claim 1, wherein the fourth tighten surface is vertically next to the third tighten surface.

4. The anti-theft toolbox as claimed in claim 1, wherein the first notch and the second notch are rectangular slots.

5. The anti-theft toolbox as claimed in claim 1, wherein the quantity of binding portions is three.

6. The anti-theft toolbox as claimed in claim 1, wherein the first locking portion has a locking duct which is inserted by the latch on the second locking portion for the second locking portion and the first locking portion to be latched together.

7. The anti-theft toolbox as claimed in claim 1, wherein the openings of the first notch and the second notch are vertical to the axis of the latch, the first tighten mass and the second tighten mass are laterally arranged with certain space corresponding to the axis of the latch for the groove to be longitudinally formed along the axis of the latch.

8. The anti-theft toolbox as claimed in claim 1, wherein the openings of the first notch and the second notch direct parallel to the axis of the latch, the first tighten mass and the second tighten mass are also separately located along the axis of the latch in parallel, and the first flange and the second flange are vertically located at the two corresponding walls of the groove.

9. The anti-theft toolbox as claimed in claim 1, wherein the first flange and the second flange have a guiding angle defined at one side edge of their end portions.

10. The anti-theft toolbox as claimed in claim 1, wherein the fourth anchor surface has a protruded edge extended at its end portion, on the rear side of the upper frame is a concave edge, and the protruded edge is anchored in the concave edge.

* * * * *